US010718574B2

(12) United States Patent
Hislop

(10) Patent No.: US 10,718,574 B2
(45) Date of Patent: Jul. 21, 2020

(54) PIN FIN HEAT EXCHANGER

(71) Applicant: SUSTAINABLE ENGINE SYSTEMS LIMITED, Lewes (GB)

(72) Inventor: Drummond Watson Hislop, Lewes (GB)

(73) Assignee: Sustainable Engine Systems Limited, Lewes (GB)

( * ) Notice: Subject to any disclaimer, the term of this patent is extended or adjusted under 35 U.S.C. 154(b) by 0 days.

(21) Appl. No.: 15/769,838

(22) PCT Filed: Oct. 21, 2016

(86) PCT No.: PCT/GB2016/053293

§ 371 (c)(1),
(2) Date: Apr. 20, 2018

(87) PCT Pub. No.: WO2017/072493

PCT Pub. Date: May 4, 2017

(65) Prior Publication Data

US 2018/0266773 A1 Sep. 20, 2018

(30) Foreign Application Priority Data

Oct. 28, 2015 (GB) ..... 1519031.7

(51) Int. Cl.
*F28D 7/02* (2006.01)
*F28F 3/02* (2006.01)
(Continued)

(52) U.S. Cl.
CPC ..... *F28F 3/022* (2013.01); *F28D 15/0275* (2013.01); *F28D 15/04* (2013.01);
(Continued)

(58) Field of Classification Search
CPC ..... F28F 3/022; F28F 1/32; F28F 1/26; F28F 2215/06; F28D 15/0275; F28D 15/046;
(Continued)

(56) References Cited

U.S. PATENT DOCUMENTS 4,145,708 A * 3/1979 Ferro ..... F28D 15/0266 257/715
4,523,636 A * 6/1985 Meijer ..... F28D 15/0233 122/366
(Continued)

FOREIGN PATENT DOCUMENTS

CN 201406385 2/2010
CN 101 893 399 11/2010
(Continued)

OTHER PUBLICATIONS

International Search Report and Written Opinion of the ISA for PCT/GB2016/053293, dated Jan. 9, 2017, 3 pages.
(Continued)

*Primary Examiner* — Claire E Rojohn, III
(74) *Attorney, Agent, or Firm* — Nixon & Vanderhye P.C.

(57) ABSTRACT

A pin fin heat exchanger including a pin fin heat pipe. A main tube of the heat pipe may divide at the evaporator end into a number of pin fin evaporators, each having fluid entrances and exits to the main tube; and at the condenser end into a number of pin fin condensers, each having fluid entrances and exits to the main tube.

23 Claims, 11 Drawing Sheets

Figure 1:
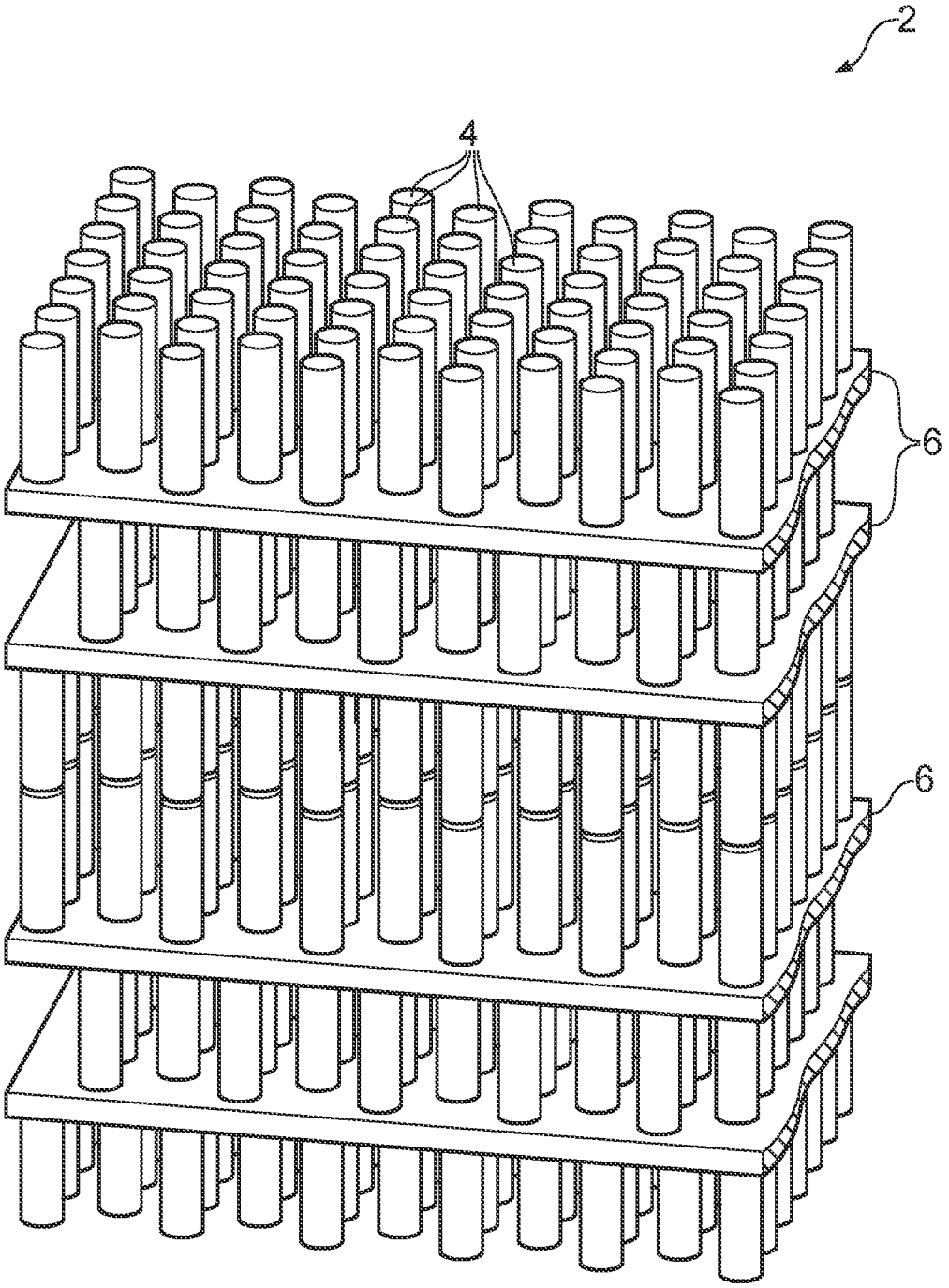
FIG. 1 (Prior Art)
Figure 2:
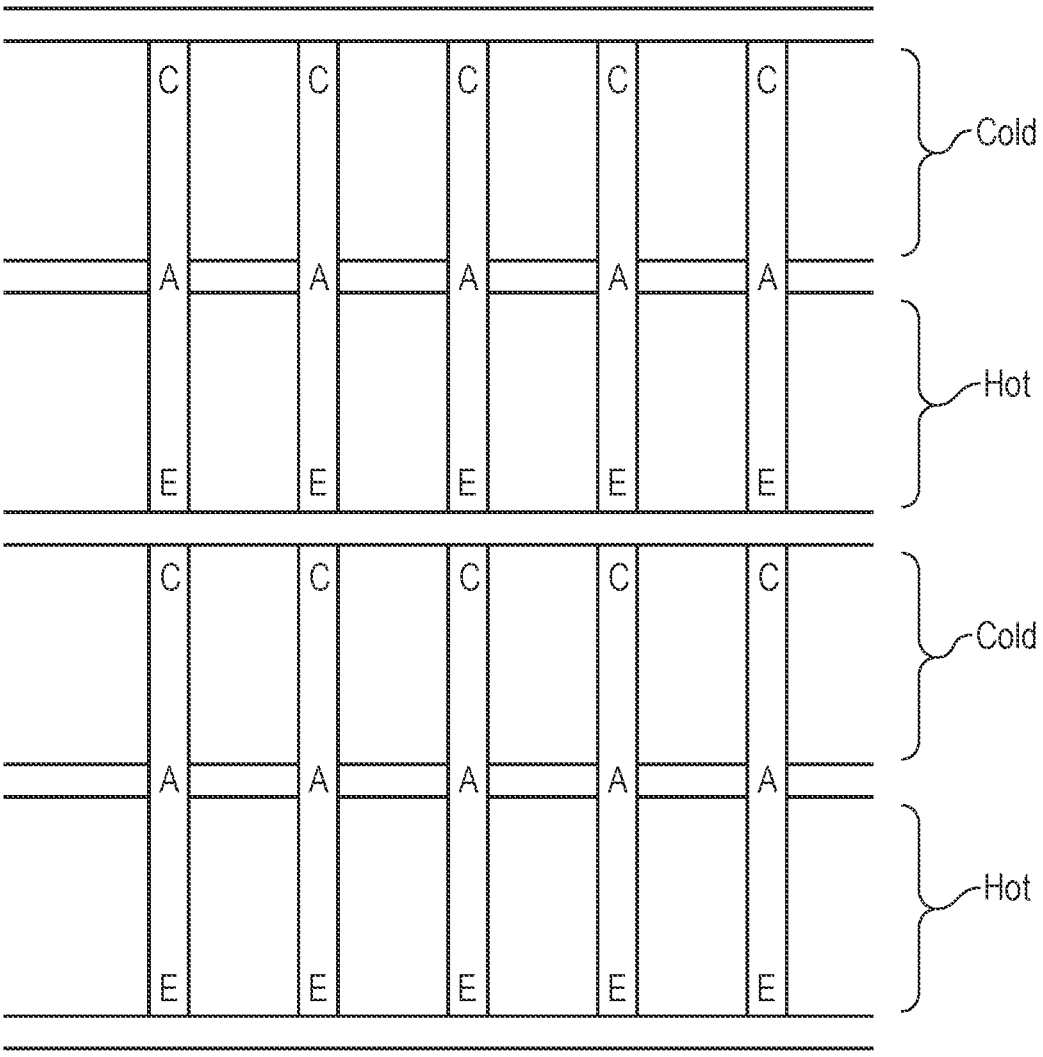
Figure 3:
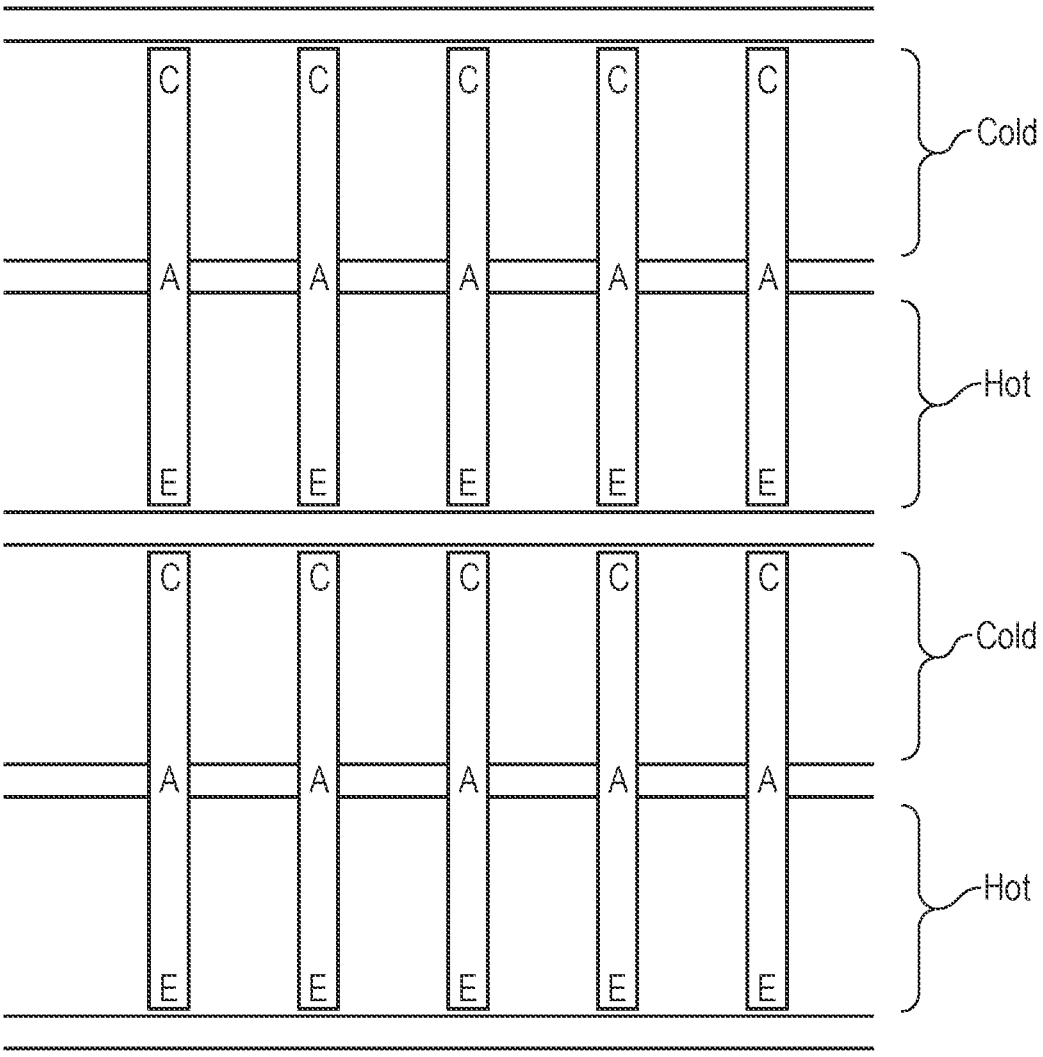
Figure 4:
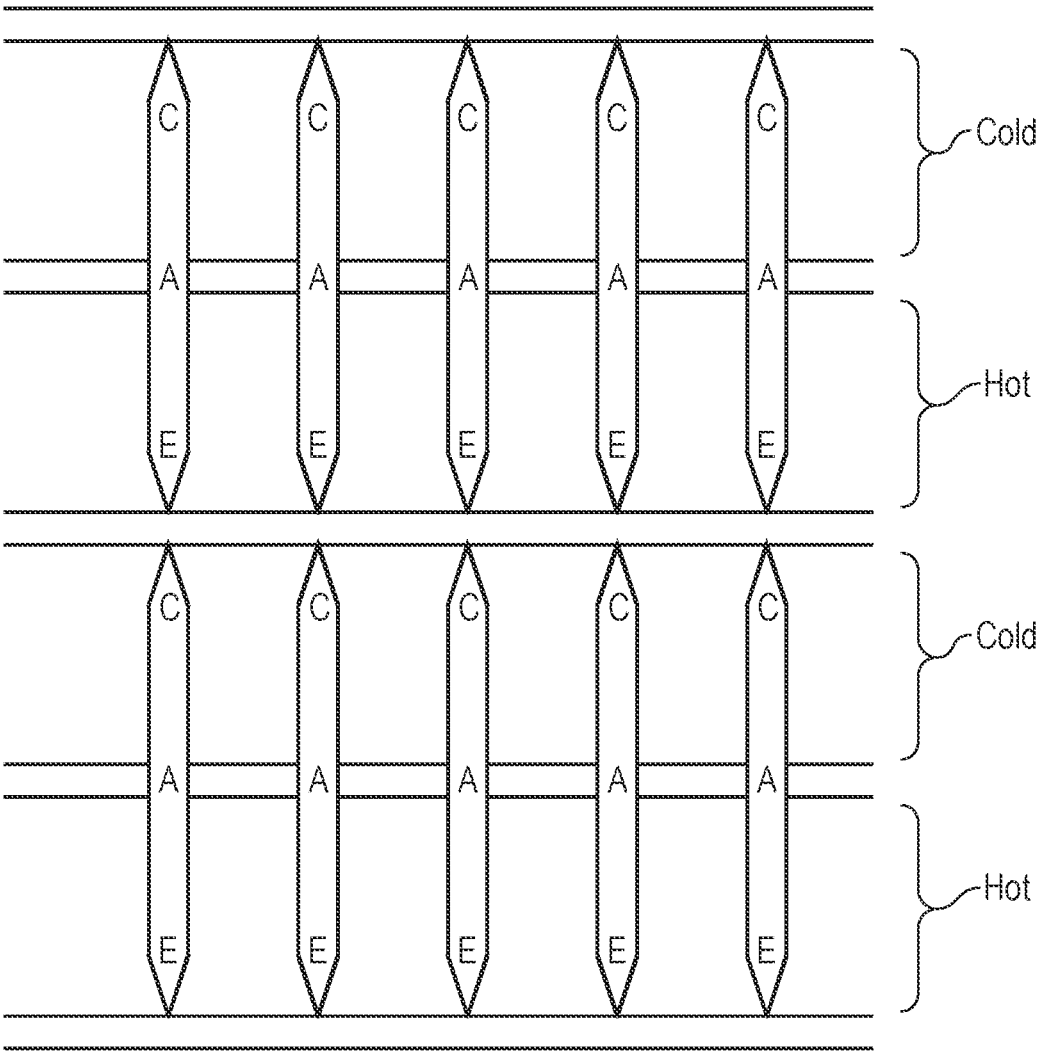
Figure 5:
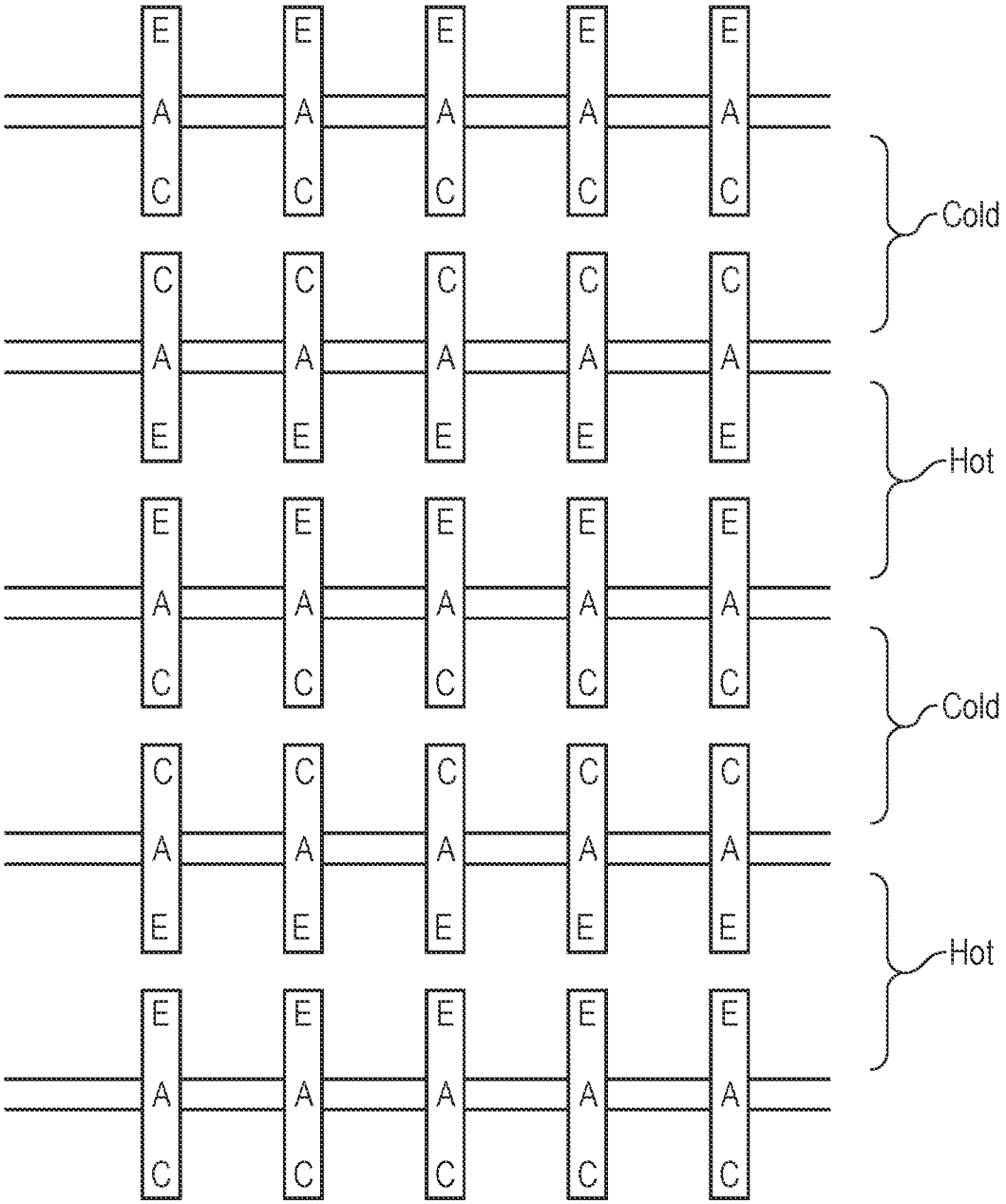
Figure 6:
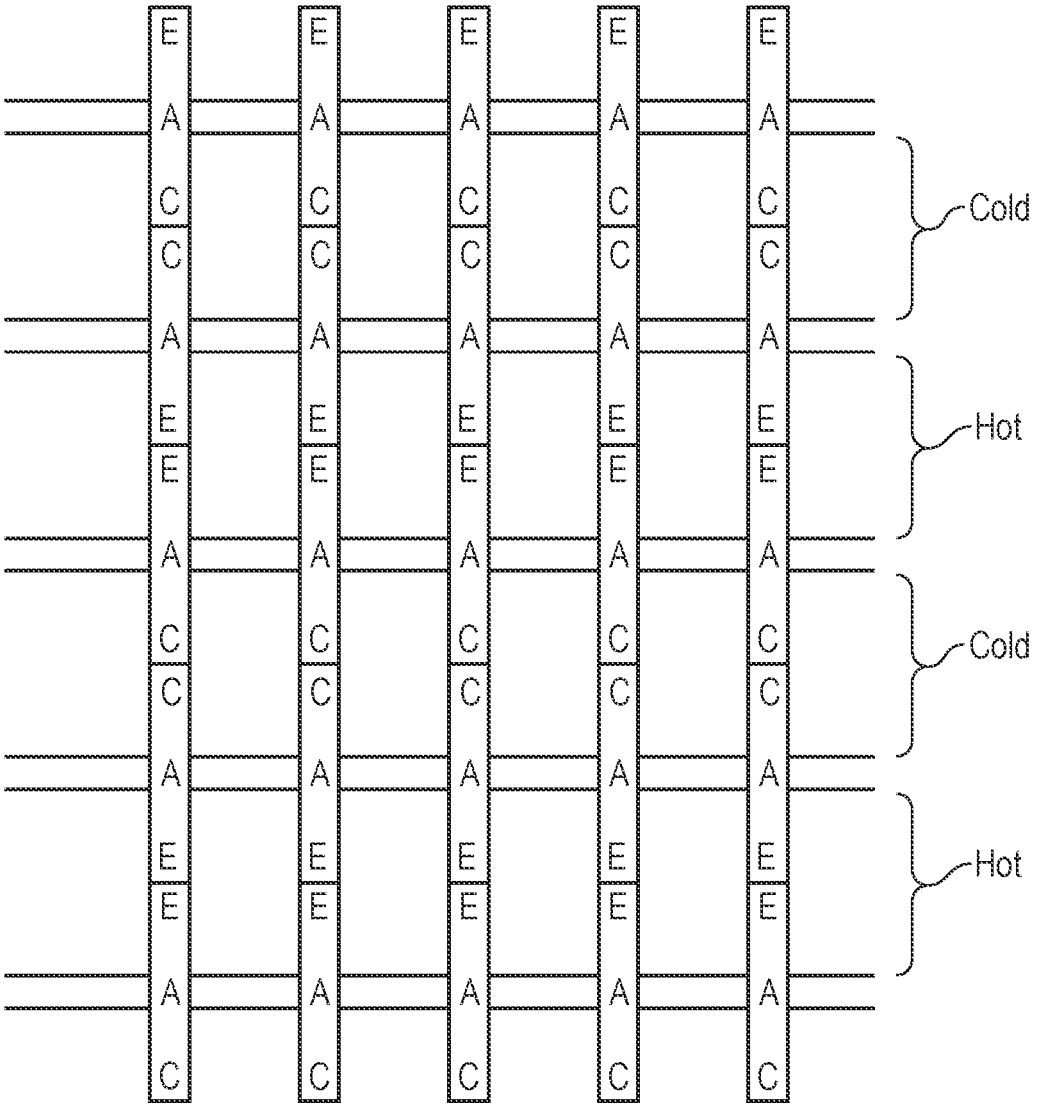

(51) Int. Cl.
*F28D 15/04* (2006.01)
*F28F 1/26* (2006.01)
*F28F 1/32* (2006.01)
*F28D 15/02* (2006.01)

(52) U.S. Cl.
CPC ..... *F28D 15/046* (2013.01); *F28F 1/26* (2013.01); *F28F 1/32* (2013.01); *F28D 2015/0216* (2013.01); *F28D 2015/0225* (2013.01); *F28F 2215/06* (2013.01)

(58) Field of Classification Search
CPC ..... F28D 15/04; F28D 2015/0216; F28D 2015/0225
USPC ..... 165/80.4, 104.21
See application file for complete search history.

(56) References Cited

U.S. PATENT DOCUMENTS 5,198,889 A * 3/1993 Hisano ..... F28D 15/0266 257/678
5,216,580 A * 6/1993 Davidson ..... F28D 15/0266 361/700
5,253,702 A * 10/1993 Davidson ..... F28D 15/0233 165/80.4
5,267,610 A * 12/1993 Culbert ..... B21D 53/085 165/151
5,386,143 A * 1/1995 Fitch ..... H01L 23/427 165/104.33
5,704,416 A * 1/1998 Larson ..... F28D 15/0241 165/104.21
5,848,637 A * 12/1998 Lee ..... A23L 3/365 165/104.21
6,237,223 B1 * 5/2001 McCullough ..... B23P 15/26 257/E23.089
6,882,051 B2 * 4/2005 Majumdar ..... B82Y 10/00 257/746
6,910,794 B2 * 6/2005 Rice ..... F28D 15/0233 362/547
7,040,383 B2 * 5/2006 Oyamada ..... H05K 5/068 165/104.21
7,369,410 B2 * 5/2008 Chen ..... F28D 15/0233 165/104.21
7,609,520 B2 * 10/2009 Chang ..... F28D 15/0233 165/104.33
7,911,052 B2 * 3/2011 Vadakkanmaruveedu ..... H01L 23/427 257/712
7,965,511 B2 * 6/2011 Refai-Ahmed ..... F28D 15/0266 361/700
8,018,720 B2 * 9/2011 Campbell ..... H05K 7/20318 361/700
8,479,805 B2 * 7/2013 Chang ..... F28D 15/0233 165/104.21
8,737,071 B2 * 5/2014 Hao ..... H01L 23/427 165/104.21
9,220,184 B2 * 12/2015 Ranjan ..... H01L 23/427
9,841,241 B2 * 12/2017 Chaix ..... B64G 1/50
10,045,464 B1 * 8/2018 Wei ..... H01L 23/427
10,054,374 B2 * 8/2018 Dinulescu ..... F28F 1/045
10,077,946 B2 * 9/2018 Sun ..... F28D 15/0266
2001/0027855 A1 * 10/2001 Budelman ..... F28F 3/022 165/80.3
2002/0021556 A1 * 2/2002 Dibene, II ..... G06F 1/18 361/704
2002/0024795 A1 2/2002 Bhatia et al.
2002/0056908 A1 * 5/2002 Brownell ..... F28D 15/0266 257/714
2002/0118511 A1 * 8/2002 Dujari ..... H01L 23/427 361/703
2004/0174651 A1 * 9/2004 Aisenbrey ..... F28D 15/04 361/103
2005/0126766 A1 * 6/2005 Lee ..... B82Y 10/00 165/133
2005/0173098 A1 * 8/2005 Connors ..... F28D 15/02 165/104.33
2006/0037738 A1 * 2/2006 Li ..... H01L 23/427 165/104.33
2007/0084593 A1 * 4/2007 Besant ..... F28D 9/005 165/167
2007/0086196 A1 * 4/2007 Wong ..... F21V 29/83 362/294
2008/0128116 A1 6/2008 Dangelo et al.
2012/0145356 A1 * 6/2012 Paschkewitz ..... B21C 37/083 165/104.26
2013/0049018 A1 * 2/2013 Ramer ..... H01L 31/052 257/81
2014/0090808 A1 * 4/2014 Bessho ..... C09K 5/063 165/104.17
2015/0000874 A1 * 1/2015 Veilleux, Jr. ..... F28D 15/04 165/104.26
2015/0027669 A1 * 1/2015 Kokas ..... F28D 15/0275 165/104.26
2015/0043168 A1 * 2/2015 Douglas ..... H01L 23/427 361/719
2015/0289413 A1 * 10/2015 Rush ..... G06F 1/20 165/53
2016/0069622 A1 * 3/2016 Alexiou ..... F21V 29/81 165/146
2016/0131440 A1 * 5/2016 Lee ..... F28D 15/0233 165/185
2018/0128553 A1 * 5/2018 Lewis ..... F28D 15/046
2019/0326797 A1 * 10/2019 Tang ..... H02K 9/20

FOREIGN PATENT DOCUMENTS

CN 103737933 A 4/2014
CN 104654669 A 5/2015
JP 10-153674 6/1998
JP 10-185468 7/1998
JP 2014-163519 9/2014
KR 10-0598516 7/2006
WO WO 2005/033607 4/2005
WO 2006/064202 6/2006
WO WO 2006/119684 11/2006
WO 2008/047096 4/2008

OTHER PUBLICATIONS

Search Report for GB1519031.7, dated May 25, 2016, 4 pages.
Office Action dated Jul. 16, 2019 issued in Chinese Application No. 201680061965.9. (translation).

* cited by examiner 52
52
52

PIN FIN HEAT EXCHANGER

This application is the U.S. national phase of International Application No. PCT/GB2016/053293 filed 21 Oct. 2016, which designated the U.S. and claims priority to GB Patent Application No. 1519031.7 filed 28 Oct. 2015, the entire contents of each of which are hereby incorporated by reference.

The present disclosure relates to a pin fin heat exchanger and a method of manufacturing a pin fin heat exchanger.

A recuperator is a heat exchanger that extracts heat from the exhaust of the turbine of a turbine engine, and uses that heat to pre-heat the air leaving the engine's compressor, before that air passes to the combustor. Pre-heating the air saves the fuel that would otherwise be needed to heat the combustion air before it mixes with the compressed air, or during or after the process of mixing the fuel and air, and thereby increases the efficiency of the turbine engine and decreases the $CO_2$ emissions for a given power output.

In general terms, the efficiency of an un-recuperated turbine engine operating at a given combustion temperature is a function of its compression ratio: that is the ratio between the compressor's exit and inlet pressures. Compression ratios of over 40 and very high efficiencies of 35% or more can be achieved in complex, multi-stage, unrecuperated turbine engines. Their complexity and high costs mean that such ratios are found only in large turbine engines used to power aeroplanes, or to provide the prime movers for power stations, particularly gas-fired power stations. In contrast, smaller unrecuperated turbine engines, and particularly micro-turbine engines, variously defined in ranges of <1 kW to 100 kW output, or up to 1 MW output, can have single stage compressors and/or turbines with compression ratios of less than 5, and efficiencies of well under 20%.

Because of their already high efficiency, and the need to minimise mass, recuperation is not used to date on large aero turbine engines, although it is found on some land or sea-based power systems, where mass is not such a constraint. In efficiency terms, the need for recuperation is greater in micro-turbine engines, where it can increase otherwise low efficiency by as much as 50%. The present disclosure is applicable to both micro-turbines and large turbines. For this reason we focus on recuperators for micro-turbine engines, abbreviated to micro-turbines, although we do not exclude their use in much larger engines.

Recuperators, like many other heat exchangers, can be built in a number of different ways, but a typical recuperator will be of the brazed or welded plate-fin type, where the fins may be conventional straight or wavy fins, pin fins or mesh fins. Other types are also available, including diffusion bonded units.

There is a wide range of potential applications for micro-turbines in, amongst others, the automotive, defence, aerospace, stationary power and clean energy sectors. However, this potential is largely unrealised, mainly because of the relatively low efficiency of unrecuperated micro-turbines, and the high costs, size and weight of the recuperators that would increase those low efficiencies. Another problem with existing recuperators, particularly high temperature recuperators, is a lack of robustness, caused by thermal fatigue and stress at the sharp and rectangular joints that are inevitable with brazing and most other joining methods. Cracking can and does result. A further problem with conventional recuperators, and other heat exchangers, is that the sources of the heat exchanging fluids—in a micro-turbine the exit of the compressor and the entry to the combustor—can be some distance apart. This means that considerable manifolding may be needed, that adds significantly to bulk, weight and cost, and also causes thermodynamic losses; because of the bulk of the heat exchanger and its manifolding, their location may have to be non-optimal, leading to further bulk, weight, costs and inefficiencies.

Potential innovative solutions are described in PCT/GB2005/004781 and PCT/GB2007/003931, which outline new types of heat exchanger manufactured by Selective Laser Melting (SLM), a version of Additive Powder Layer manufacture that processes metal alloys in powder form. The advantages of SLM heat exchangers include high levels of 3-D design freedom, which in turn allow a wide range of design innovations, including improved packaging and integration of heat exchangers with the other components of the systems (eg engines) in which they are used, and elimination of the sharp junctions associated with conventional designs and manufacturing methods. Despite these advantages, SLM recuperators may still be too expensive because of the present high costs of the SLM process itself, although these costs are forecast to fall dramatically in the future; similarly, SLM recuperators may still be too large or heavy for commercial applications despite the reductions in size and weight that might be enabled by SLM.

A potential alternative to both the conventional heat exchanger and the new SLM versions is the heat pipe. The heat pipe is a known component, a basic version of which consists of an evacuated tube that is partially filled with a working fluid and then sealed. The working fluid is chosen according to the temperatures at which the heat pipe must operate, so that the heat pipe can contain both saturated liquid and its vapour or gas phase over the operating temperature range. Examples of working fluids range from helium for extremely low temperature applications, to molten sodium and indium for extremely high temperatures.

In operation, the saturated liquid vaporizes in the hot or evaporator end of the tube and travels through an adiabatic section to the cold or condenser end of the tube, where it is cooled and condenses back to a saturated liquid. Where the condenser is located above the evaporator in a gravitational field, gravity may be sufficient to return the liquid to the evaporator, and, strictly speaking, the heat pipe is a thermosyphon. More typically, the condensed liquid is returned to the evaporator using a wick structure attached to the inside of the heat pipe tube wall. The wick exerts a capillary action on the liquid phase of the working fluid. This allows operation of a heat pipe without the assistance of gravity.

Wick structures used in heat pipes include sintered metal powders, meshes, and grooved wicks, which comprise a series of grooves in the inside wall of the tube, typically parallel to the heat pipe's axis. Typically, the wick is in the form of an annulus contained by the main heat pipe tube, leaving a central aperture through which the fluid in the vapour phase can pass. In a composite variation, the wick may contain within it clear passageways that allow some of the working fluid to pass through the wick with minimal pressure drop. Other variations include the arterial wick, that provides a low-pressure drop path for transporting liquid from the condenser to the evaporator, where it is redistributed around the heat pipe circumference using a wick around the heat pipe wall.

The advantage of heat pipes over many other heat-dissipation or exchanging mechanisms derives from the high heat fluxes generated in the evaporation and condensation of the working fluid at the hot and cold ends of the heat pipe respectively. In turn, this results in high thermal conductivity and in high efficiency in transferring heat from one location to another. A pipe 2.5 cm in diameter and 0.6 metres long can transfer 3.7 kWh at 980° C. with only 10° C. temperature drop from end to end. Some heat pipes have demonstrated heat fluxes of more than 23 kW/cm$^2$. Another advantage of heat pipes is that the evaporator and condenser can be separated from each other, sometimes by considerable distances, and convoluted paths between them are possible. This avoids much of the manifolding and inconvenient location of a conventional heat exchanger.

Heat pipes are widely used in specific applications, such as cooling electronics, where they conduct heat away from enclosed and/or hard to reach components to locations better suited to transferring or dispersing that heat to another fluid or to atmosphere. An example is a laptop computer, where heat pipes are commonly used to conduct heat from an integrated circuit at the centre of the computer to a heat exchanger at the edge, where a small fan may be used to increase rates of heat exchange between the heat pipe's working fluid and the surrounding atmosphere. Heat pipes are also used in space applications where they can operate in the absence of gravity.

However, outside the limited number of such applications, heat pipes are not widely used to replace conventional heat exchangers, largely because of size, efficiency and manufacturing cost issues. In principle the heat pipe comprises two separate heat exchangers joined by the adiabatic section; it uses an internal working fluid in addition to the two or more fluids between which its function is to make heat exchange possible. All other things being equal, this can result in a conventional heat pipe being larger than the heat exchanger that it is intended to replace. A particular reason is that large secondary heat transfer surface areas, usually in the form of fins, are needed to balance the heat fluxes on either side of the heat pipe wall, especially when one or both heat-exchanging fluids heat are gases. This is because the heat flux between the heat pipe wall and the working phase change fluid inside it can be at least an order of magnitude greater than the heat flux between the wall and a single phase fluid outside it. The fins used to increase the heat transfer are typically thin, with consistent fin thickness and limited area contact with the main tube. Fin efficiency is low, which increases the number and/or size of the fins needed. It will be clear that this significantly increases the size and weight of the heat pipe. For these reasons, and except in specific circumstances, the heat pipe does not normally take the place of a conventional heat exchanger.

Heat pipes may be manufactured in a variety of ways. At its simplest, a heat pipe can take the form of a tube into which a wick in the form of a mesh sleeve is inserted; in more complex forms the wick may take the form of a sintered powder. In some cases, the wick may be formed in part from narrow grooves on the inside wall of the heat pipe, that will be sufficient to provide the capillary action need for the heat pipe to function. Composite wicks may contain more than one element: for example, sintered material with small pores to provide a driving capillary force, and larger open channels to provide greater fluid flow with less fluid friction. With the development of additive manufacturing methods, and more specifically of Selective Laser Melting (SLM), it now becomes possible to build SLM torms of conventional heat pipes, and this has been done by Thermacore International Inc. for space applications.

At least some embodiments of the disclosure provide a pin fin heat exchanger comprising at least one pin fin heat pipe, said at least one pin fin heat pipe having a cavity to contain working fluid The present techniques provide developments in the design of heat pipes that address the present size, weight and cost constraints on the wider use of heat pipes as heat exchangers in a wide range of applications.

At least some embodiments of the disclosure provide a method of manufacturing a pin fin heat exchanger as mentioned above comprising additive manufacturing.

Figure 7:
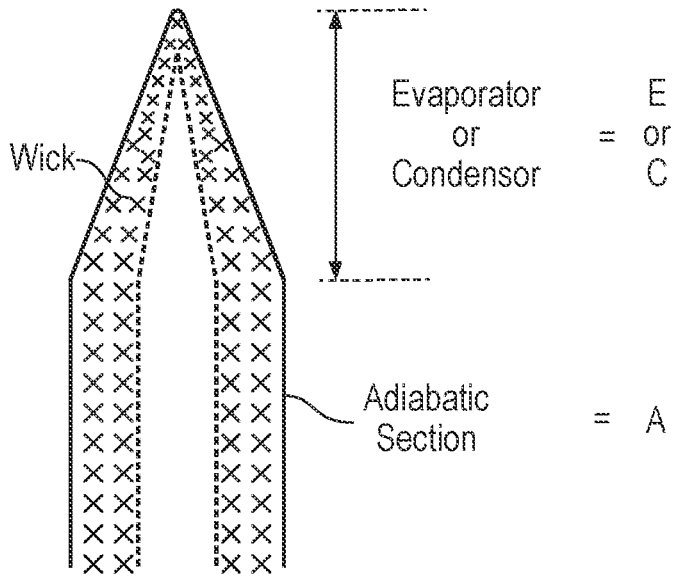
Figure 8:
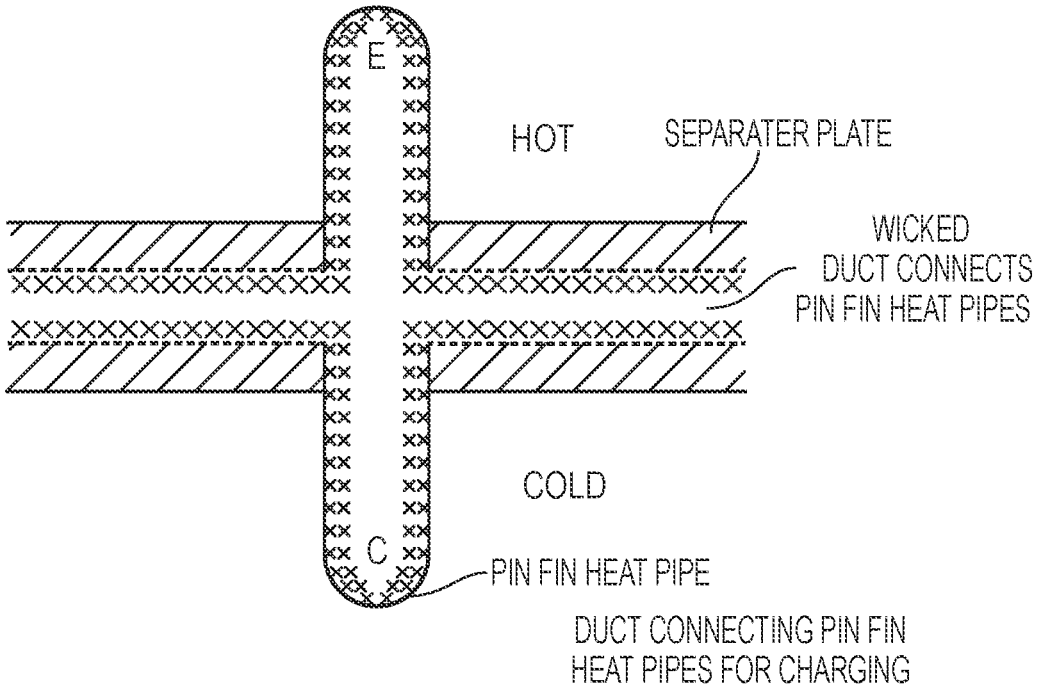
Figure 9:
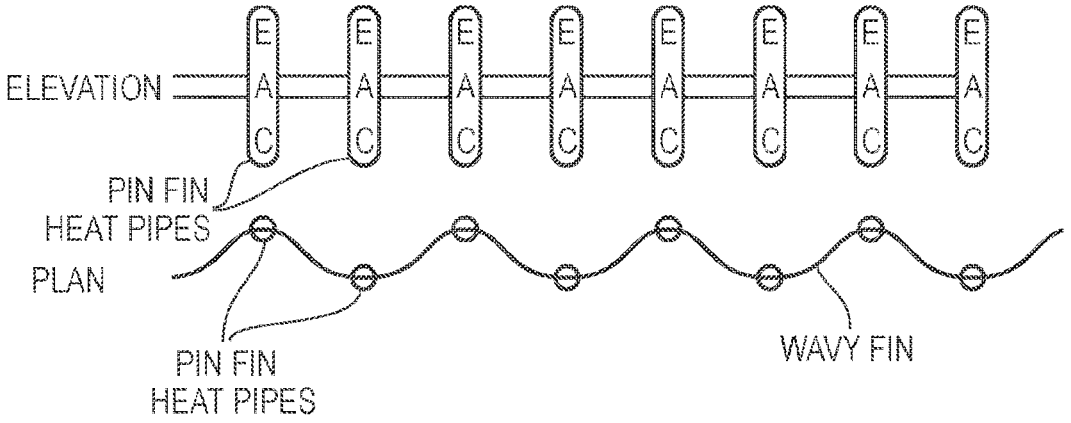
Figure 10:
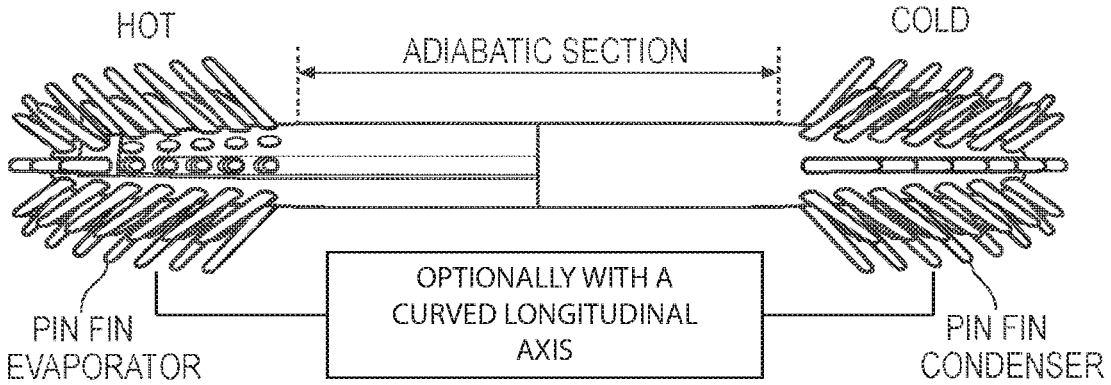
Figure 11:
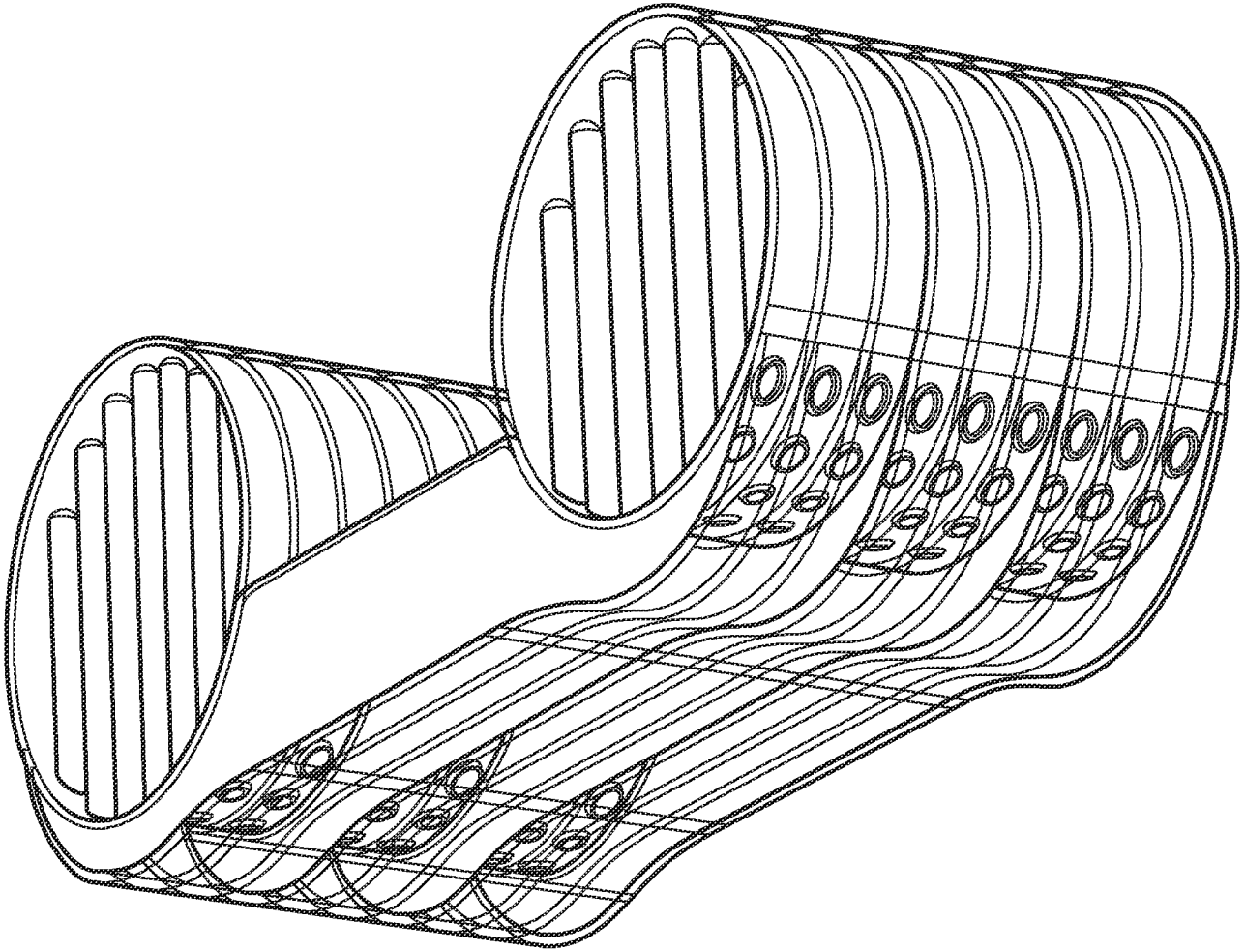
Figure 12:
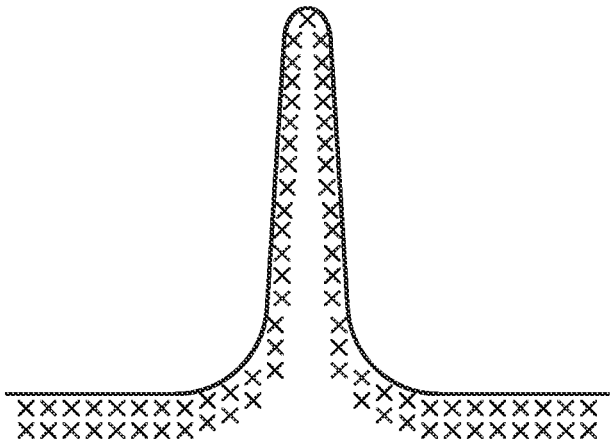
Figure 14:
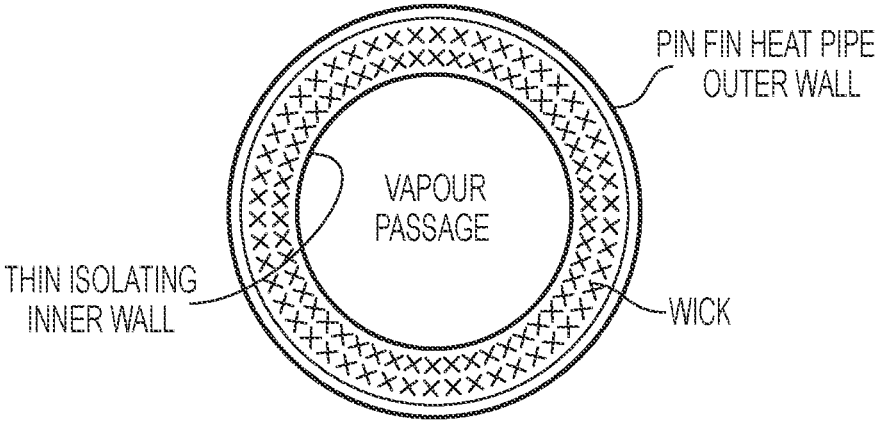
Figure 13:
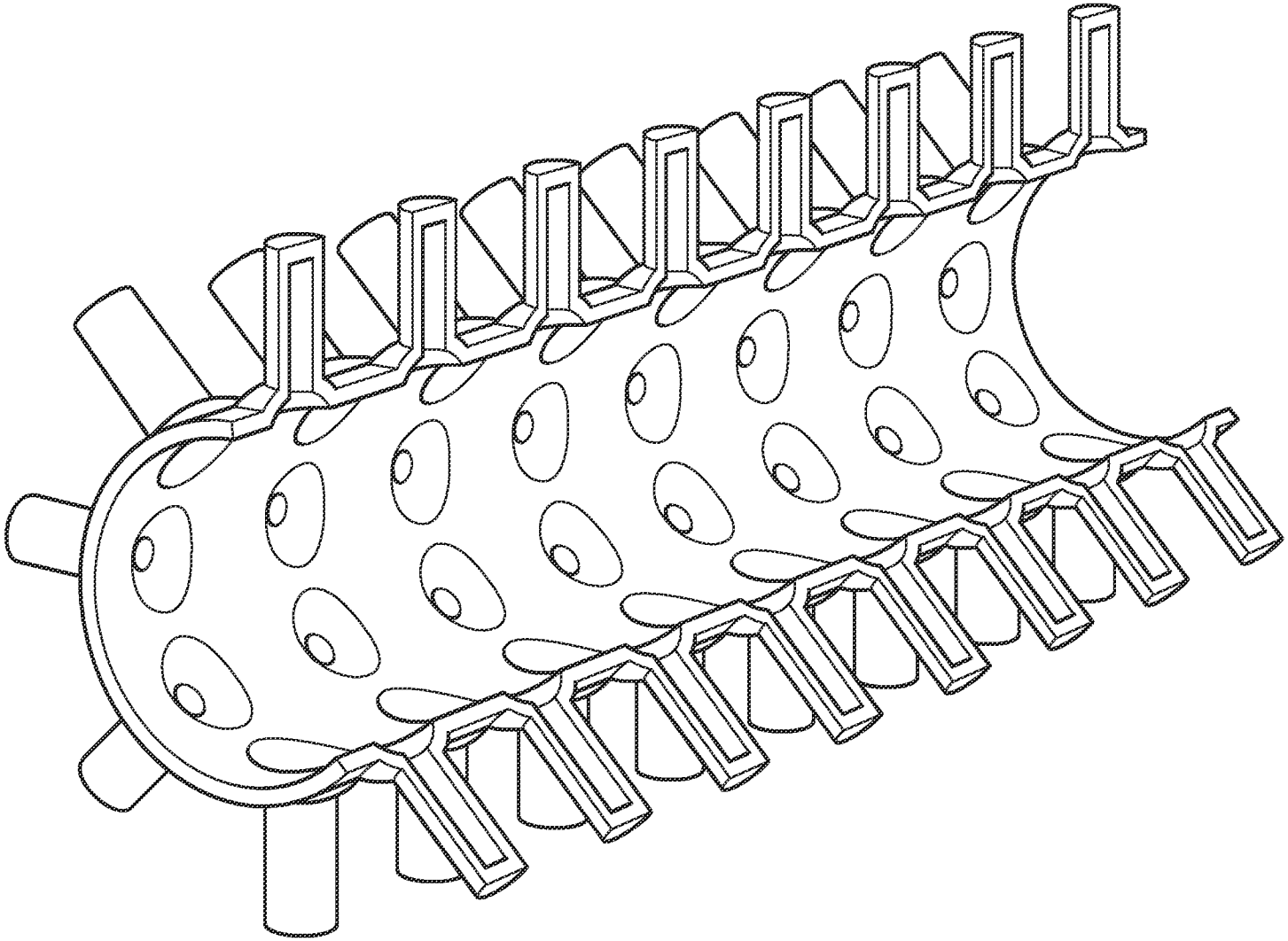

FIG. 1 schematically illustrates a pin fin heat exchanger;

FIGS. 2 to 6 schematically illustrate various example embodiments of a pin fin heat exchanger including pin fin heat pipes;

FIG. 7 schematically illustrates a tapered pin fin heat pipe;

FIG. 8 schematically illustrates a duct connecting pin fin heat pipes for charging;

FIG. 9 schematically illustrates pin fin heat pipes integrated with a wavy wall fin;

FIG. 10 schematically illustrates a pin fin heat pipe;

FIG. 11 schematically illustrates a pin fin recuperator;

FIG. 12 schematically illustrates a curved transition in a pin wall, a reduction in wick thickness and partial isolating wall;

FIG. 13 schematically illustrates increasing the volume of the transition area between a main tube and a pin fin heat pipe; and FIG. 14 schematically illustrates a thin wall isolating a wick from a vapour passage.

There is disclosed a heat exchanger in which part or the whole of the heat exchanger is replaced by one or more heat pipes, or by parts of heat pipes. This significantly increases the thermal conductivity of the different components of the heat exchanger and allows reductions in size, weight and costs. The manufacture of such heat exchangers may be achieved using additive manufacturing techniques, and in particular metal powder-bed selective laser melting (SLM). The present pin fin heat exchangers apply to a wide range of heat pipe categories, including loop heat pipes, capillary pumped heat pipes, pulsating heat pipes, variable conductance heat pipes, rotating heat pipes and sorption heat pipes.

Three main example embodiments of a basic capillary heat pipe are described herein, although further forms are also possible.

In a first example embodiment, pin fins in the form of heat pipes replace the pin fins in a conventional pin fin plate heat exchanger that, for the sake of clarity of description, is assumed to be oriented so that the plates are flat and horizontal and the pin fins are vertical. WO-A-2005/033607 (see FIG. 1 of the accompanying drawings) discloses a typical pin-fin plate heat exchanger 2 in which fins, in the form of solid pins 4, form secondary heat transfer surfaces. These secondary heat transfer surfaces enhance the heat exchange between fluids flowing between adjacent parallel plates 6 that form the primary heat transfer surfaces. The gaps between pairs of plates are partly or completely bridged by the pins, whose longitudinal axes are typically, but not necessarily, perpendicular to the planes of the parallel plates. Typically, the pins may be fixed, typically welded or brazed, to the separating plates or primary heat transfer surfaces. One end of a pin may be fixed to one separating plate, and the other to a neighbouring separating plate, so that the pin spans the entire gap between the separating plates.

There are other options. A pin fin may be fixed to a separator plate at only one end, with a small gap between the other end and the next separator plate; two pin fins whose longitudinal axes are aligned may span the gap between two separator plates, with a small gap between their free ends, or their free ends may be joined; such fins may not be aligned in their longitudinal axes; or individual pin fins may pass through a separator plate, each through its own separate hole, and typically be welded or brazed so that one portion of the pin-fin is exposed to the fluid on one side of the plate and another portion of the pin-fin is exposed to the fluid on the other side of the plate. The join is preferably sealed as part of the welding, brazing or other joining process so that fluid cannot pass through the hole in which the pin fin is fixed, although in some cases small amounts of fluid leakage may be tolerated. It will be clear that different combinations of these or other similar arrangements are also possible. The choice of arrangement, or of combinations of arrangements, will depend on different heat transfer and strength requirements, and on the details of manufacturing technique. In general, fixing one pin fin to two separator plates that it spans, or joining two pin fins with aligned longitudinal axes, that together span the gap between adjacent plates, will tend to make the heat exchanger stronger and more resistant to higher pressure; but it may also make it more vulnerable to distortion at high temperatures.

When at least some of the pin fins are replaced by pin fin heat pipes, the number of arrangements may be more limited. This is because in order that the pin fin heat pipes to operate as required, the evaporator of each pin fin heat pipe should be exposed to the hotter of two fluids exchanging heat, while the condenser should be exposed to the cooler of the two fluids. So a pin fin heat pipe that is entirely contained between two adjacent separator plates, and within one fluid from which, or to which, heat is to be transferred, cannot operate as a heat pipe. A preferable arrangement is therefore for each pin fin heat pipe to pass through a separator plate, so that the adiabatic section of the pin fin heat pipe coincides with, and is the length of, the thickness of the separator plate, leaving one end—the evaporator—exposed to the hotter fluid side of the plate and the other—the condenser—exposed to the cooler fluid on the other side of the separator plate. As before, the method used to fix the pin fin heat pipe will preferably seal the joint between the pin fin heat pipe and the separator plate.

The pin fin heat pipe(s) may have a transverse cross-sectional area, including the cavity within the pin fin heat pipes, of one of: less than 20 $mm^2$; less than 5 $mm^2$; and less than 0.8 $mm^2$.

In a further preferable arrangement a pin fin heat pipe is long enough to span the gaps between three consecutive separator plates, passing through and being fixed and sealed in a hole in the middle plate. As before, one or both the ends of such a pin fin heat pipe may be fixed to one or both of the inward facing surfaces of the outer two of the three separator plates that each pin-fin heat pipe spans (see FIG. 2); or there may be a gap between one or both ends and one or both of the outer pair of separator plates (see FIG. 3).

As previously noted, an advantage of the outer end of the pin fin heat pipe being fixed to the inner surface of one or both of the two outer separator places is that it provides a stronger structure; a disadvantage is that in the arrangement described above, the end of the hot evaporator section will be in thermal contact with a separator plate, the other side of which is in contact with the colder fluid, with the danger that the performance of the evaporator might be compromised by losing heat to the colder fluid. This effect may be minimised by tapering the end of the pin fin heat pipe to reduce the heat transfer contact with the separator plate while maintaining sufficient contact for joining and strength purposes (see FIG. 4).

In an alternative arrangement, two shorter pin fin heat pipes with their longitudinal axes aligned may span the gap between two adjacent separator plates, and partly intrude into the heat transfer spaces on the other sides of the adjacent separator plates. The upper end of the lower pin fin heat pipe and the lower end of the upper pin fin heat pipe may be separated by a small gap when viewing the arrangement with the separator plates horizontal (see FIG. 5); or the ends may be joined (see FIG. 6). Alternatively their longitudinal axes may not be aligned. It will be clear that combinations of pin fin heat pipes with aligned and non-aligned longitudinal axes are possible, depending on differing heat exchange and strength requirements.

A potential disadvantage of this alternative arrangement is that in half of the pin fin heat pipes the evaporator will be above the condenser, which may result in poorer heat transfer performance than is achievable in the pin fin heat pipes in which the evaporators are below the condensers, because of the lack of gravitational assistance to the capillary force. In these cases, adjustment to the relative proportions of the two orientations of pin fin heat pipes, and/or their sizes, may be used to compensate for the difference in heat exchanger performance.

An additional advantage of any of these arrangements is that tertiary heat transfer surfaces can be created by adding fins to one of more of the pin fin evaporators and/or condensers during their SLM construction. Further, and depending on the size of each pin fin evaporator or condenser, such fins may themselves incorporate micro-pin fin evaporators and/or condensers that connect with the main pin fin evaporators and/or condensers in a manner described in more detail in the third example embodiment described below.

One method of building the core of a pin fin heat exchanger, which uses pin fin heat pipes instead of conventional pin fins, is to manufacture the quantities of pin fin heat pipes required separately from the other components of the heat exchanger, such as the separating plates, and to assemble the heat exchanger, for example as described in US-A-2007/084593, with the pin fin heat pipes replacing the original pin fins. In this example embodiment each pin-fin is a self-contained heat pipe.

The angle that the pin fin heat pipe makes with the separator plate may be other than 90°, and that the separator plate may not be flat. Indeed, heat transfer and/or pressure drop advantages may be obtained by the pin fin heat pipes being at an angle, for example 45°, to the plane of the separator plate so that they resemble or form a mesh. Similar advantages may be obtained by the separator plate(s) being corrugated in one or more planes.

As the working fluid in the liquid phase flows along the evaporator from the adiabatic section towards the outer end of the pin fin heat pipe, the amount of liquid that remains to be evaporated decreases, as does the amount of vapour flowing in the opposite direction. It follows therefore that the dimensions of both the wick carrying the liquid, and the aperture or apertures that carry the vapour, can be reduced, so that the overall diameter of the evaporator can reduce between the evaporator end of the adiabatic section and the end of the evaporator. Similar changes in dimensions can be applied to the condenser end of the pin fin heat pipe. Thus the evaporator and condenser sections of the pin fin heat pipe can be tapered (see FIG. 7). By these means, the size, weight and cost of the whole heat pipe may be reduced. There are also heat transfer and pressure drop advantages from such arrangements. In particular, tapering the pin fin heat pipe can result in greater fin efficiency, without the size and weight increases that would result from similar changes in geometry to a conventional pin fin.

SLM is a convenient and cost effective method of manufacturing such pin fin heat pipes in large numbers. An automated means of charging SLM pin fin heat pipes with their working fluid can be provided to take advantage of what would preferably be the vertical orientation of large numbers of SLM pin fin heat pipes on a horizontal SLM build platform before they are removed from the platform by electrical discharge machining, or other means.

A second embodiment that integrates SLM heat pipes into existing heat exchanger formats uses SLM to build the whole core of a heat exchanger, integrating the pin fin heat pipes with the other SLM structures and components of the heat exchanger. The principle of building the whole core of a heat exchanger in SLM is shown in WO-A-2006/064202 and WO-A-2008/047096. In a pin fin heat pipe version, the separator plates and the pin fin heat pipes will be integrated in the same single SLM build, eliminating any welding or brazing.

In a second example embodiment, an additional feature is provided to enable the pin fin heat pipes to be charged with their working fluid. An SLM wicked duct connects two or more pin fin heat pipes, preferably through small holes in their adiabatic sections, to a working fluid charging point. Preferably this duct will pass through an outer wall of the heat exchanger so that the charging point in conveniently located outside the heat exchanger. This duct can be incorporated within the thickness of each separating plate through which the fin pin heat pipes pass, the thickness of the separating plate being increased if and where necessary to provide any extra space needed to accommodate the duct (see FIG. 8). The duct may pass through the enclosing plates and/or any manifolds, and terminate in a location convenient for charging the pin fin heat pipes connected to that duct. More than one row, or other selection of connecting ducts, may be collected together at the edge of, or outside the heat exchanger core, to reduce the number of points at which charging of the heat pipes has to be undertaken. Where possible, in order to ease and reduce the costs of charging, it may be desirable to connect not just the pin fin heat pipes passing through one separator plate, but also the pin fin heat pipes passing through two or more, or even all, the separator plates, so that just one, or at least fewer charging points are required. To reduce any detrimental effects on pin fin heat pipe performance due to the "dead space" of the connections between the pin fin heat pipes and the charging point or points, the hydraulic diameter of the charging duct or ducts within each plate will be small.

The pin fin heat pipes may be combined with conventional pin fins, or with other means of enhancing heat transfer, such as those that provide secondary, or even tertiary, heat transfer surfaces, for example thin walls which may be straight or wavy or take other forms. The pin fin heat pipes may be separated from such secondary or tertiary heat transfer surfaces, or they may be integrated with them in the sense of having direct contact with them rather than secondary contact via a separator plate. For example, a fin may take the form of a wavy wall that joins two or more pin fin heat pipes along all or a significant proportion of their length (see FIG. 9).

A third example embodiment, enabled by SLM, increases the heat transfer area between the outer wall of the heat pipe's evaporator, and/or condenser, and the hot and cold fluid respectively by creating separate SLM evaporators and condensers—i.e. two or more—at the hot end portions and/or the cold end portions of the heat pipe respectively, instead of the normal single evaporator and condenser. Each separate evaporator and/or condenser has its own liquid and vapour inlets/outlets to the common main tube. Each of these separate evaporators and condensers may take the form of a pin fin, and for convenience are referred to herein as pin fin evaporators and pin fin condensers respectively, although of course they may take other forms of fin. For example, in one example embodiment based on an otherwise conventional heat pipe with a large number of high heat transfer surface fins attached to either end or to both ends of the heat pipe, if the whole heat pipe is manufactured using SLM, then one or more pin fin evaporators may be incorporated in one or more of the existing fins at the evaporator end of the heat pipe, similar to the arrangement shown in FIG. 10.

The method of operation is as follows. Working fluid in the liquid phase flows from the condenser towards the evaporator end of the heat pipe, passing along the wall of the adiabatic section, or through its wick if one is provided. As it reaches the evaporator section, the liquid flow is divided into sub-flows, each liquid sub-flow being directed through an aperture in the wall of the main tube of the heat pipe and into the hollow body or tube of one of a number of single pin fin evaporators that extend from the main tube of the heat pipe. As in the adiabatic section of the heat pipe, the liquid will flow along the wall of the pin fin evaporator or through a wick if it is provided. Alternatively, each aperture may lead to a duct that serves a number of sub-apertures, each of which serves an individual pin fin evaporators.

Similarly, the vapour flow from each pin fin evaporator passes, in the reverse direction to that of the liquid entering it, back down the centre of the pin fin evaporator's tube, through the same aperture into the main heat pipe tube and is aggregated into a single, larger vapour flow that passes along the main tube and then flows as normal along the adiabatic section to the condenser, where there is a similar division and aggregation of liquid and vapour flows respectively. FIG. 10 shows an example embodiment in which the pin fin heat pipes emerge from the main tube of what is the layout of a conventional straight tube heat pipe.

FIG. 11 shows an example embodiment in which the pin fin evaporators of appropriately varying length are arranged within the circular exit of the turbine of a micro-turbine, in a plane perpendicular to the longitudinal axis of the turbine's exit; and pin fin condensers are similarly arranged at the circular combustion air inlet of the micro-turbine's compressor, thus forming a pin fin heat pipe recuperator. In each case, the inner ends of the pin fins terminate in an appropriately area ruled manifold that becomes the adiabatic section of the overall heat pipe. In another version, in order to overcome the against gravity operation of the evaporators, the manifold could be routed to be on the top of the exit, while the condenser is at the bottom, so that the adiabatic section pumps against gravity at, for example, 45 degrees.

Further potential benefits include reduction of the thermal stress problems inherent in conventional high temperature heat exchanger design; reduction or even elimination of manifolding; reductions in fluid friction; and the ability to improve the compactness of systems through more optimised packaging. For example, on a Stirling engine the evaporator of an SLM pin fin heat exchanger might be integrated into an SLM porous combustor, while the condenser forms a low internal volume heater that can be integrated with an SLM cylinder head. The SLM pin fin heat exchanger also reduces, or even eliminates, the powder removal problems inherent in SLM builds of fine lattice or porous structures, of ducts with very low hydraulic diameters of less than 1 mm, and complex internal structures. In such circumstances, it is difficult if not impossible to guarantee that all surplus powder particles have been removed, which may have serious consequences if powder particles in, for example, a recuperator, get transported to the compressor or turbine where they might damage blades or bearings. In the case of an SLM heat pipe, the volumes in which loose powder might remain are sealed inside the heat pipe and cannot reach any moving parts; in small quantities they will have no adverse discernible effect on the heat pipe performance Indeed, it is feasible that under some circumstances they might enhance performance by increasing the capillary action.

The shape of each single pin evaporator, the angle that it makes with the main tube, and its orientation to the tube can be chosen to suit specific conditions and applications. Typically the pin fin evaporator will be straight, but curved pin fin evaporators are also possible, as are spiral, involute and other geometries. Typically, the longitudinal axis of the pin fin evaporator at the point at which it joins the main tube will intersect with the longitudinal axis of the main tube, at an angle of 45-90°, although other angles are possible. The longitudinal axis of a pin fin evaporator at the point at which it joins the main tube may also be canted sideways, so that it does not intersect with the longitudinal axis of the main tube.

The geometry and dimensions of the aperture (cavity) are the main means of flowing the correct amount of fluid into the pin fin evaporator or condenser. A continuously or partly curved transition surface is preferred between the inner surface of the wall of the main heat pipe tube and the inner surface of the wall of the pin fin evaporator or condenser to ensure ease of liquid flow into the latter (see FIG. 12). Where the heat pipe operates with a wick, it will similarly be advantageous to provide a continuously or partly curved flow-efficient transition between the wick in the main heat pipe tube and the wick in the pin fin evaporator or condenser to help ensure uninterrupted flow of the working fluid into the pin fin evaporator or condenser (see FIG. 12). Choosing the thickness of the wick in the pin fin evaporator or condenser in relation to its thickness in the main tube of a wicked heat pipe can be a means of ensuring the correct amount of fluid flow into the pin fin evaporator or condenser. It will be clear that in this context the thickness of the wick at in any pin fin evaporator or condenser will be significantly less than that of the wick in the main heat pipe tube (see FIG. 12).

As each main tube aperture reduces the area available for liquid flow along the wick, it may be necessary to increase the depth of the wick in those areas of the wick surrounding an aperture in which flow along the main tube is not actually impeded by the aperture. One option is to increase the thickness of the wick inwards from the tube wall. A disadvantage of this option is that vapour flow through the tube may thereby be restricted. In turn, this may increase the rate of entrainment, characteristics of which are described in the following paragraph. An alternative is to make space for the extra wick thickness by increasing the volume of the transition area outwards from the original line of the cylinder wall, again particularly in those areas of the wick surrounding an aperture in which flow along the main tube is not actually impeded by the aperture (see FIG. 13).

A characteristic of heat pipes is that at the interface between the surface of a wick along which working fluid in the liquid phase is flowing and working fluid in the vapour phase that is passing, usually in the opposite direction, the vapour will exert a shear force on the liquid in the wick. The magnitude of the shear force will depend on the vapour properties and velocity, and its effect will be to entrain droplets of liquid and transport them to the condenser end. This tendency to entrain is resisted by the surface tension in the liquid. Entrainment will negatively affect the performance of the heat exchanger, and represents one limit to its performance One means of preventing entrainment is to isolate some or all of the wick from the vapour by one or more thin walls. This is normally difficult, or even impossible to achieve with conventional means of manufacture. However, in an SLM heat pipe of the type already described such a thin wall can be constructed as part of the single build of the SLM heat pipe. In the adiabatic section such a wall will typically be cylindrical and contain the wick on its outside surface (see FIG. 14). This has the added advantage that the wick can then typically be constrained between two cylindrical walls, each of which acts as the support or anchorage for the construction of the wick itself during the SLM process. In turn this reduces problems of SLM construction of wick geometries in which the nodes on the inner extremes of a wick-forming lattice are only partially supported during SLM construction.

In the transition between the main tube and a pin fin evaporator and/or condenser, a similar wall, normally curved, may be needed to stabilise the SLM build at that point and/or to reduce or eliminate entrainment in an area in which it might otherwise be significant because of the convex curvature of the wick at that point (see FIG. 12).

In a manner similar to that already noted for the first embodiment, as the working fluid in the liquid phase flows outwards along the pin fin evaporator or condenser from the junction between the pin fin evaporator or condenser and the main tube, the amount of liquid that remains to be evaporated decreases, as does the amount of vapour flowing in the opposite direction. It follows therefore that the dimensions of both the wick carrying the liquid and the aperture through which the vapour passes can be reduced, so that the overall diameter of the pin fin evaporator or condenser can reduce between the junction between it and the main tube and its outer end. Thus, the evaporator and condenser sections of the pin fin evaporator or condenser can be tapered, as well as the main tube as already described in the first embodiment. By these means the size, weight and cost of the whole heat pipe may be reduced. There are also heat transfer and pressure drop advantages from such arrangements. In particular, tapering the pin fin heat pipe can result in greater fin efficiency, without the size and weight increases that would result from similar changes in geometry to a conventional pin fin.

This design increases the primary, direct heat transfer surface area between the heating and cooling fluids and the heat pipe's working fluid. In turn, the secondary surface area needed on the outside of the heat pipe will fall, making the whole system much smaller, lighter and cheaper.

In a variation on the third embodiment, the heat pipe's main tube may divide at the evaporator end into two or more sub-tubes, each of which provides working fluid flow into and out of a number of individual pin fin evaporators as described in the third embodiment. Similarly, the heat pipe's main tube may divide at the condenser end into two or more sub-tubes, each of which provides working fluid flow into and out of a number of individual pin fin condensers as described in the third embodiment.

In a further variation, instead of a single main tube or adiabatic section, the heat pipe may consist of a two or more sub-tubes, each of which has its own adiabatic section, and each of which may link a group of pin fin evaporators at one end and a group of pin fin condensers at the other end, rather than being aggregated into a single main tube. The individual sub-tubes may be built as one piece, and will preferably have hexagonal cross-sections which reduces size, weight and costs, by providing walls in common between two or more sub-tubes.

It will be clear that, as in any heat exchanger, the temperature will change over its flow length, so the temperature of pin fin heat pipe heat exchanger will also change over its flow length. In many cases, the desirable temperature drop over the whole length of the pin fin heat pipe heat exchanger will be greater than the operating range of a single heat pipe working fluid. In this case, more than one pin fin heat pipe working fluid will be used, each working fluid being used by a separate pin fin heat pipe or group of pin fin evaporators and/or condensers.

The above described example embodiments may be manufactured using additive manufacturing (such as SLM). In particular an energy beam may be used to trace the shape of the pin fin heat exchanger(s), e.g. as part of a powder bed additive manufacturing using selective laser melting.

The invention claimed is:

1. A pin fin heat exchanger comprising at least one pin fin heat pipe, said at least one pin fin heat pipe having a cavity to contain working fluid;

said at least one pin fin heat pipe comprising a main tube and a plurality of branching pin fin heat pipe end portions projecting from said main tube, each branching pin fin heat pipe end portion comprises a part of said cavity and comprises a wicking layer bounding said part of said cavity; and the plurality of branching pin fin heat pipe end portions have curved longitudinal axes.

2. The pin fin heat exchanger as claimed in claim 1, wherein said at least one pin fin heat pipe has a transverse cross-sectional area including said cavity of one of:

less than 20 $mm^2$;

less than 5 $mm^2$; and less than 0.8 $mm^2$.

3. The pin fin heat exchanger as claimed in claim 1, comprising a separator plate to separate a first fluid from a second fluid, wherein an end of said at least one pin fin heat pipe nearest the separator plate is tapered.

4. The pin fin heat exchanger as claimed in claim 1, wherein said cavity is bounded with a wicking layer, and a thickness of said wicking layer increases with distance from an end of said pin fin heat pipe toward a middle of said pin fin heat pipe.

5. The pin fin heat exchanger as claimed in claim 1, comprising a plurality of pin fin heat pipes with respective cavities interconnected to permit common charging with said working fluid.

6. The pin fin heat exchanger as claimed in claim 5, wherein said cavities are connected to a charging conduit.

7. The pin fin heat exchanger as claimed in claim 6, comprising a separator plate to separate a first fluid from a second fluid, wherein said charging conduit is contained within a thickness of said separator plate.

8. The pin fin heat exchanger as claimed in claim 6, comprising a plurality of charging conduits connected together before reaching a shared charging point.

9. The pin fin heat exchanger as claimed in claim 1, comprising a fin including a respective end portion of a plurality of pin fin heat pipes.

10. The pin fin heat exchanger as claimed in claim 9, wherein each end of said at least one pin fin heat pipe is divided to form a plurality of end portions to provide a respective one of a plurality of evaporators or a plurality of condensers.

11. The pin fin heat exchanger as claim 9, wherein said end portions have a fluid connection and a vapour connection with a main body of said at least one pin fin heat pipe where said end portions meet said main body.

12. The pin fin heat exchanger as claimed in claim 1, when a link wicking layer extends between said main tube and said at least one branching pin fin heat pipe, said link wicking layer having a greater thickness proximal to a junction between said main tube and said at least one branching pin fin heat pipe end portion.

13. The pin fin heat exchanger as claimed in claim 12, comprising an inner wall to block liquid flow from said link wicking layer to said cavity proximal to said junction.

14. The pin fin heat exchanger as claimed in claim 1, comprising at least one pin fin heat pipe, said at least one pin fin heat pipe having a cavity to contain working fluid;

said at least one pin fin heat pipe comprising a main tube and a plurality of branching pin fin heat pipe end portions projecting from said main tube, said plurality of branching pin fin heat pipe end portions providing a plurality of evaporators; wherein a transverse cross sectional area of said main tube decreases proximal to at least one end of said main tube; and a transverse cross sectional area of said plurality of evaporators decreases with increasing distance from the main tube.

15. The pin fin heat exchanger as claimed in claim 1, wherein said main tube is divided into a plurality of sub tubes, said at least one branching pin fin heat pipe end portion projecting from one of said plurality of sub tubes.

16. The pin fin heat exchanger as claimed in claim 1, wherein said cavity is bounded with the wicking layer, and the pin fin heat exchanger comprises, an inner wall to block liquid flow from said wicking layer to said cavity, said inner wall extending along at least an adiabatic portion of said at least one pin fin heat pipe.

17. A method of manufacturing the pin fin heat exchanger as claimed in claim 1, comprising additive manufacturing.

18. The pin fin heat exchanger as claimed in claim 1, comprising at least one pin fin heat pipe, said at least one pin fin heat pipe having a cavity to contain working fluid;

said at least one pin fin heat pipe comprising a main tube and a plurality of branching pin fin heat pipe end portions projecting from said main tube;

wherein each branching pin fin heat pipe end portion comprises a part of said cavity and comprises a wicking layer bounding said part of said cavity; and at least one of:

said plurality of branching pin fin heat pipe end portions provide a plurality of evaporators and longitudinal axes of at least two of said evaporators are non-parallel; and said plurality of branching pin fin heat pipe end portions provide a plurality of condensers and longitudinal axes of at least two of said condensers are non-parallel.

19. A pin fin heat exchanger comprising at least one pin fin heat pipe, said at least one pin fin heat pipe having a cavity to contain working fluid;

said at least one pin fin heat pipe comprising a main tube and a plurality of branching pin fin heat pipe end portions projecting from said main tube;

wherein each branching pin fin heat pipe end portion comprises a part of said cavity and comprises a wicking layer bounding said part of said cavity; and at least one of:

said plurality of branching pin fin heat pipe end portions provide a plurality of evaporators and said evaporators meet said main tube at evaporator junctions, where said evaporator junctions are at respective positions distributed over a three-dimensional curved surface; and said plurality of branching pin fin heat pipe end portions provide a plurality of condensers and said condensers meet said main tube at condenser junctions, where said condenser junctions are at respective positions distributed over a three-dimensional curved surface.

20. The pin fin heat exchanger as claimed in claim 19, wherein at least one of the evaporator junctions are at respective positions distributed at different points about a first circumference of the main tube; and the condenser junctions are at respective positions distributed at different points about a second circumference of the main tube.

21. The pin fin heat exchanger as claimed in claim 1, wherein the main tube has a transverse cross sectional area that decreases along a direction from a midpoint of the main tube towards an end of the main tube that includes the pin fin heat pipe end portions.

22. The pin fin heat exchanger as claimed in claim 18, wherein:

said plurality of branching pin fin heat pipe end portions provide said plurality of evaporators and longitudinal axes of at least two of said evaporators are non-parallel; and said plurality of branching pin fin heat pipe end portions provide said plurality of condensers and longitudinal axes of at least two of said condensers are non-parallel.

23. The pin fin heat exchanger as claimed in claim 19, wherein:

said plurality of branching pin fin heat pipe end portions provide said plurality of evaporators and said evaporators meet said main tube at said evaporator junctions, where said evaporator junctions are at respective positions distributed over a three-dimensional curved surface; and said plurality of branching pin fin heat pipe end portions provide said plurality of condensers and said condensers meet said main tube at said condenser junctions, where said condenser junctions are at respective positions distributed over a three-dimensional curved surface.

* * * * *